United States Patent [19]

Trassl et al.

[11] 4,257,234

[45] Mar. 24, 1981

[54] VALVE ARRANGEMENT FOR TURBOSETS

[75] Inventors: Werner Trassl; Gerhard Purr; Helmut Scheffczyk, all of Mülheim, Fed. Rep. of Germany

[73] Assignee: Kraftwerk Union Aktiengesellschaft, Mulheim an der Ruhr, Fed. Rep. of Germany

[21] Appl. No.: 29,743

[22] Filed: Apr. 13, 1979

[30] Foreign Application Priority Data

Apr. 17, 1978 [DE] Fed. Rep. of Germany ..... 2816598

[51] Int. Cl.[3] ..... F01B 21/04

[52] U.S. Cl. ..... 60/719; 137/362; 415/38

[58] Field of Search ..... 60/657, 646, 719, 720, 60/679; 137/343, 362; 415/36, 38, 44

[56] References Cited

U.S. PATENT DOCUMENTS

| | | | |
|---|---|---|---|
| 2,745,422 | 5/1966 | Wilson | 415/38 |
| 3,533,710 | 10/1970 | Haug | 137/362 |
| 3,731,702 | 5/1973 | Bellati et al. | 137/343 |

FOREIGN PATENT DOCUMENTS 1551207 3/1972 Fed. Rep. of Germany .

*Primary Examiner*—Allen M. Ostrager
*Assistant Examiner*—Stephen F. Husar
*Attorney, Agent, or Firm*—Herbert L. Lerner

[57] ABSTRACT

In a turboset having a high-pressure turbine stage and at least another turbine stage mounted on foundation supports and largely disposed above a machine floor, the high-pressure turbine stage being connectible to main steam lines, a valve arrangement includes emergency-stop main-steam governing valves through the high-pressure turbine stage is connectible to the main steam lines, the emergency-stop main-steam governing valves being disposed forward of the head of the high-pressure turbine stage and below the machine floor, and including an upper foundation ceiling disposed approximately at the level of the machine floor and formed with beams from which the emergency-stop main-steam governing valves are thermally displaceably suspended.

13 Claims, 9 Drawing Figures

VALVE ARRANGEMENT FOR TURBOSETS

Figure 1:
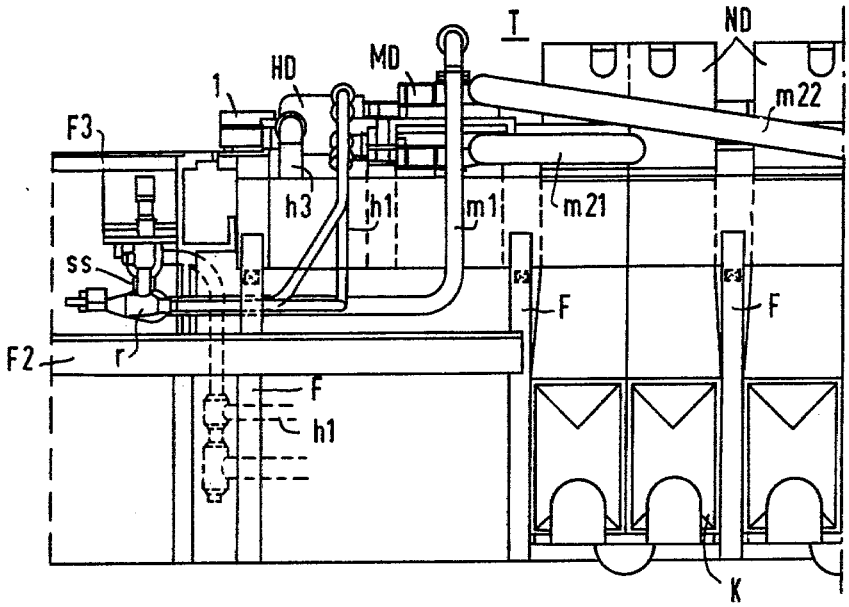

The invention relates to a valve arrangement for turbosets with high-pressure and/or medium-pressure and possibly low-pressure turbine sections which are preferably mounted coaxially or equidistantly on foundation supports and are largely disposed above a machine floor, the high-pressure turbine section being connected to the main steam lines through main-steam quick-action or emergency stop governing valves.

Such a valve arrangement has become known heretofore from German Patent DE-PS No. 1 551 207. In this connection, the quick-action control or emergency-stop governing valves (which have the function of fast-closing or emergency-stop intercept governing valves) of the medium-pressure turbine sections or stages are arranged laterally to these turbine sections in recesses or niches which are formed by the arrangement of the low-pressure cross-over pipe lines and by the arrangement of the low-pressure turbine sections, which have a considerably greater overall volume or size, axially behind the medium-pressure turbine sections. The main-steam emergency-stop governing valves of the high-pressure turbine sections are likewise arranged laterally to the machine axis i.e. laterally to the high-pressure casings or housings. Both the valves for the medium-pressure as well as those for the high-pressure turbine sections are mounted above the machine floor.

With this heretofore known valve arrangement, it follows from the fact that the capacity of the turbosets and, therewith, also the size of the combined main steam emergency-stop governing valves and the emergency-stop intercept governing valves have seen a marked increase in the last 10 to 15 years, the accessibility of the turbine bearing housings, the valves and the turbine sections or stages per se has become increasingly more difficult, especially in installations which contain four quick-closing or emergency-stop intercept governing valves. This makes the installation or assembly, servicing and encasement more difficult. In addition, a relatively complicated arrangement of the control oil lines is necessary. In principle, these difficulties are already found in the high-pressure turbine section or stage with the valves associated therewith. It is, therefore, an object of the invention to provide a valve arrangement for turbosets of the type mentioned at the introduction hereto which avoids the hereinaforementioned difficulties encountered by previously known valve arrangements of this general type and wherein, more specifically, accessibility of the main-steam fast-closing or emergency-stop governing valves of the high-pressure turbine section or stage, of the bearing housings thereof and of the turbine casing or housing per se is improved and, resulting therefrom, installation or assembly and servicing thereof are facilitated and the arrangement of the control oil lines as well as the lagging or encasement are simplified.

With the foregoing and other objects in view, there is provided in accordance with the invention, a turbosets having a high-pressure turbine stage and at least another turbine stage mounted on foundation supports and largely disposed above a machine floor, the high-pressure turbine stage being connectible to main steam lines, a valve arrangement comprising emergency-stop main-steam governing valves through which the high-pressure turbine stage is connectible to the main steam lines, the emergency-stop main-steam governing valves being disposed forward of the head of the high-pressure turbine stage and below the machine floor, and including an upper foundation ceiling disposed approximately at the level of the machine floor and formed with beasm from which the emergency-stop main-steam governing valves are thermally displaceably suspended.

In accordance with another feature of the invention, the other stage is a medium-pressure turbine stage connectible to steam lines coming from a reheater, the valve arrangement also includes emergency-stop intercept governing valves through which the medium-pressure turbine stage is connectible to the steam lines coming from the reheater, the emergency-stop intercept governing valves being also disposed below the machine floor and thermally displaceably suspended from the beams forming the upper foundation, the emergency-stop intercept governing valves being also located together with the emergency-stop main-steam governing valves forward of the head of the high-pressure turbine stage.

In accordance with a further feature of the invention, the other turbine stage is a medium-pressure turbine stage connectible to steam lines coming from a reheater, and axially aligned with the high-pressure turbine stage, the valve arrangement also including emergency-stop intercept governing valves through which the medium-pressure turbine stage is connectible to the steam lines coming from the reheater, the emergency-stop intercept governing valves being also disposed below the machine floor and thermally displaceably suspended from the beams forming the upper foundation, the emergency-stop intercept governing valves being located laterally of the axis of the turboset.

A valve arrangement is accordingly obtained which optimally meets the given spatial and the desired operating conditions. The advantages thereof can be summarized briefly as follows: 1. Better installation or assembly sequence, 2. better accessibility of the high-pressure and the medium-pressure turbine section or stage and of the bearing housing of the turbines, 3. simpler arrangement of the control oil lines, 4. simpler lagging or enclosure, 5. ease of inspection, 6. thermally elastic mounting and connection of the valves to the main steam lines. In addition, it should be noted that the noise level above the machine floor can be reduced considerably by relocating the valve housings away from the turbine sections and combining them in several sub-floor units preferably arranged in-line with one another, and that also the fire protection thereof can be improved. Each individual valve can be partitioned off within the valve line-up or alignment; danger of ignition of escaping hydraulic oil or machine oil, which could come into contact with hot turbine parts, is markedly reduced.

In accordance with an added feature of the invention, the valve of at least one of the emergency-stop main-steam and the intercept governing valve types are respectively disposed in mutual alignment.

This especially facilitates the installation or assembly and the lagging. Tests have shown that the volume or amount of pipelines which is arranged between the respective fast-closing or emergency-stop valves and the steam inlet nozzles of the respective turbine sections or stages, is somewhat greater in the arrangement according to the invention as compared to the heretofore known valve arrangement according to the hereinaforementioned German Patent DE-PS No. 551 207; this results in a slight increase in the run-up speed i.e. the rotary speed which is reached by the turboset before it is intercepted, in the case of a shutdown, by the fast-closing or emergency-stop valves. This run-up speed must not be higher than 10% above the nominal speed. The increase in the run-up speed, however, is so small that, if necessary, in conjunction with the control measures, it can virtually be ignored, whereas the hereinabove-explained advantages attainable with the invention, carry considerable weight.

In accordance with an additional feature of the invention, the high-pressure and medium-pressure turbine stages are in axial alignment and the main-steam and intercept governing valves are disposed virtually mirror-symmetrically to the longitudinal axis of the turboset, all of the valves of one of the emergency-stop main-steam and intercept governing valve groups being centrally suspended and half of the valves of the other of the governing valve groups, respectively, being disposed on both sides of the valves of the one governing valve group.

In accordance with a concomitant feature of the invention, the other turbine stage is a medium-pressure turbine stage connectible to steam lines coming from a reheater, the valve arrangement also including emergency-stop intercept governing valves through which the medium-pressure turbine stage is connectible to the steam lines coming from the reheater, the main-steam and the intercept governing valves, respectively, being formed of a combination of an emergency-stop valve member and a governing valve member, respectively, disposed perpendicularly to one another, the emergency-stop valve member having a housing with a vertical longitudinal axis, and including suspension elements for the suspension of the governing valves, the suspension elements engaging with the respective emergency-stop valve member.

In accordance with another feature of the invention, the suspension elements are formed as tie rods spring-elastically suspending the governing valves, the tie rods being articulatingly connected at one end thereof to the beams of the upper foundation ceiling and articulatingly connected at the other end thereof to the housing of the emergency-stop valve member.

In accordance with yet another feature of the invention, the tie rods are formed, respectively, of a pin part and a sleeve part having respective stops associated therewith, and including a stack of cup springs slidably received on the pin part and having respective ends in engagement with the stops for mutually coupling the pin part and the sleeve part.

In accordance with yet a further feature of the invention, there is provided a threaded connection secured against turning located at an end of the tie rods for adjusting the length thereof.

In accordance with yet an additional feature of the invention, the articulating connection between the tie rods, on the one hand, and the beams and the housings of the emergency-stop valve members, on the other hand, is formed by gimbal-like articulating locations.

In accordance with yet another feature of the invention, the gimbal-like articulating locations, respectively, include articulating-joint eyes formed on the tie rods and having spherical bearing surfaces, support plates extending from the beams of the upper foundation ceiling, articulating joint pins, fixed to the support plates and to the housings of the emergency-stop valve members, respectively, the articulating-joint eyes, respectively, surrounding and engaging the articulating joint pins.

In accordance with still another feature of the invention, the upper foundation ceiling is formed with shoulders, and the beams of the upper foundation ceiling have an approximately triangular configuration and are disposed with a three-point support, respectively, in vicinity of the points of the triangle, on the shoulders formed on the upper foundation ceiling, the tie rods extending vertically downwardly from the support plates to three of the articulating locations formed on the periphery of the respective housing of the emergency-stop valve member.

In accordance with still an additional feature of the invention, the three articulating locations are uniformly distributed over the periphery of the respective housing of the emergency-stop valve member.

Other features which are considered as characteristic for the invention are set forth in the appended claims.

Although the invention is illustrated and described herein as embodied in valve arrangement for turbosets, it is nevertheless not intended to be limited to the details shown, since various modifications and structural changes may be made therein without departing from the spirit of the invention and within the scope and range of equivalents of the claims.

Figure 2:
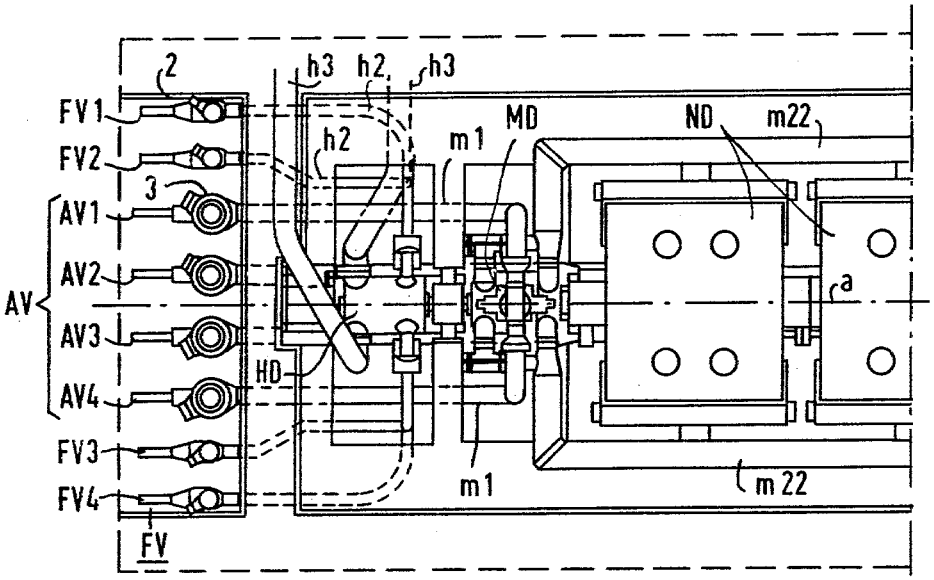
Figure 3:
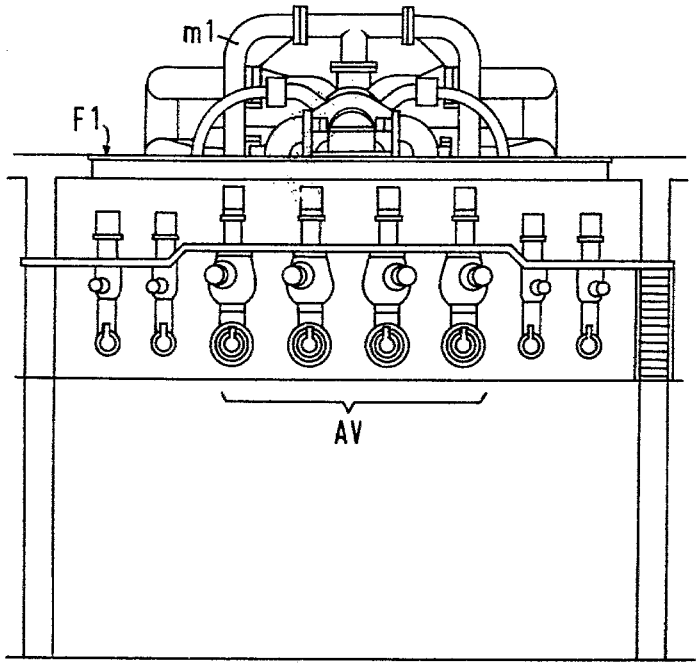
Figure 6:
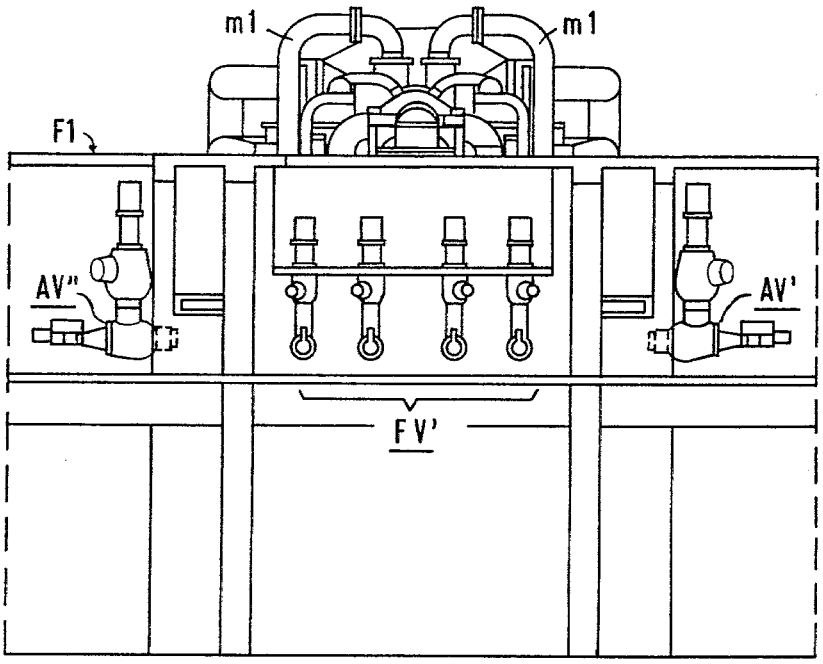
Figure 4:
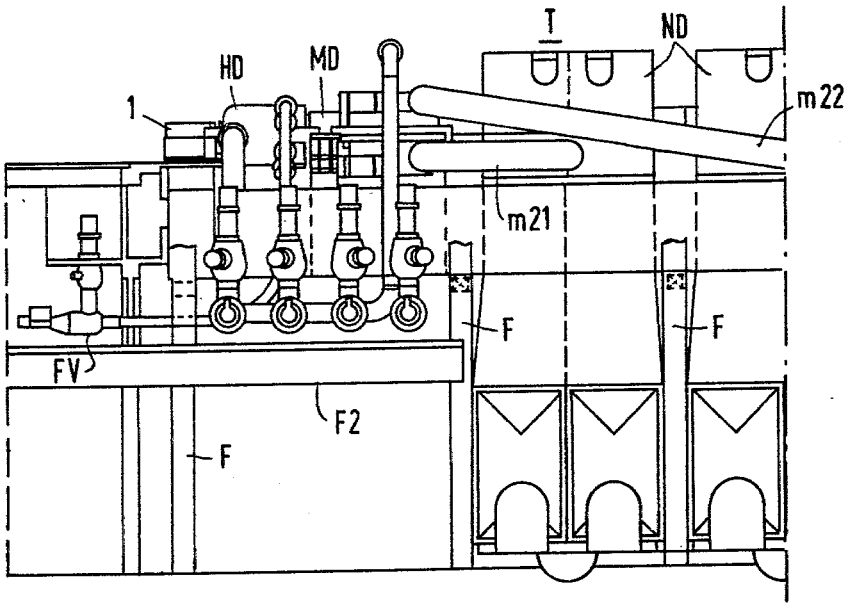
Figure 5:
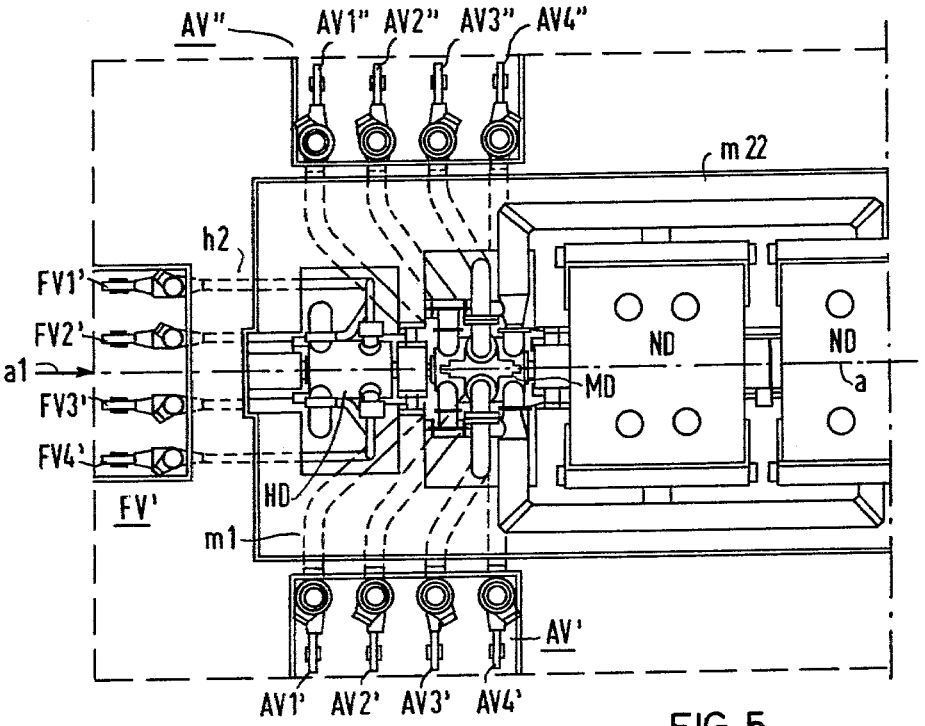
Figure 7:
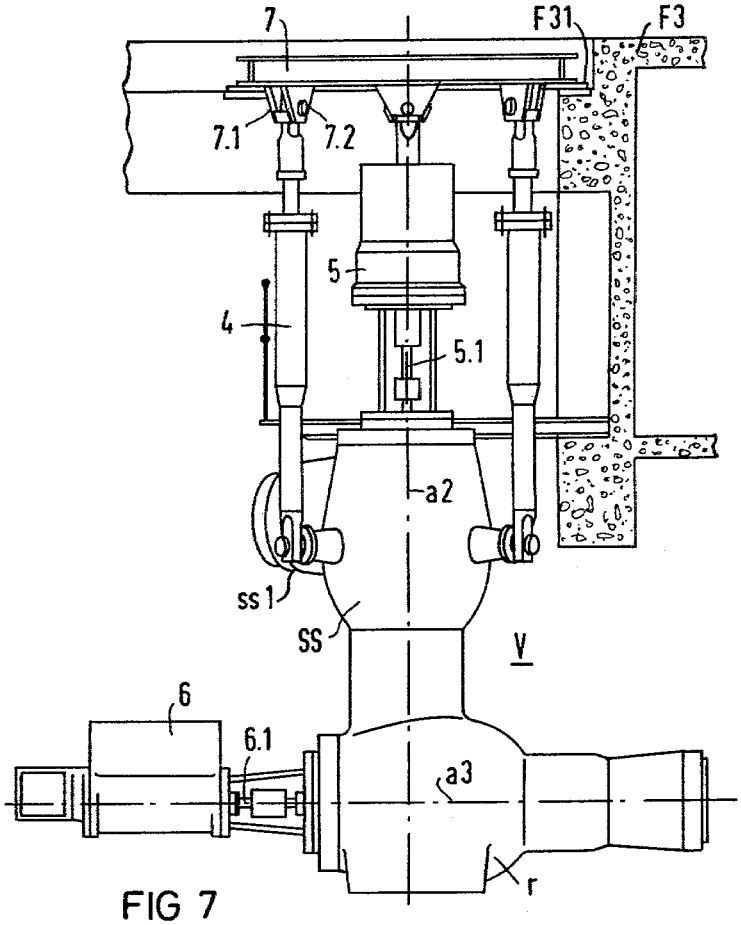
Figure 8:
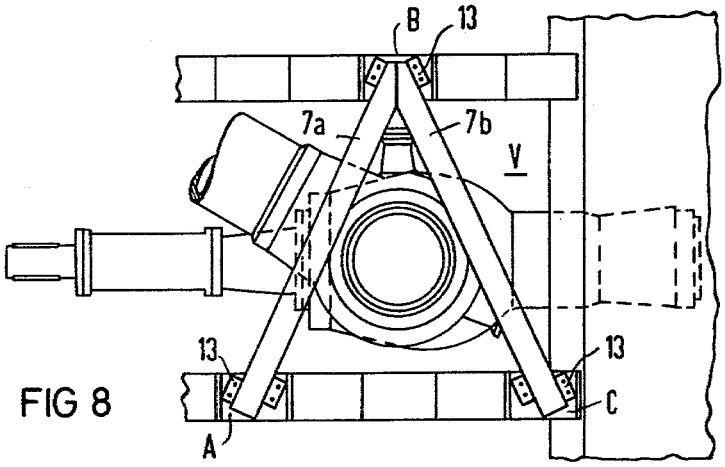
Figure 9:
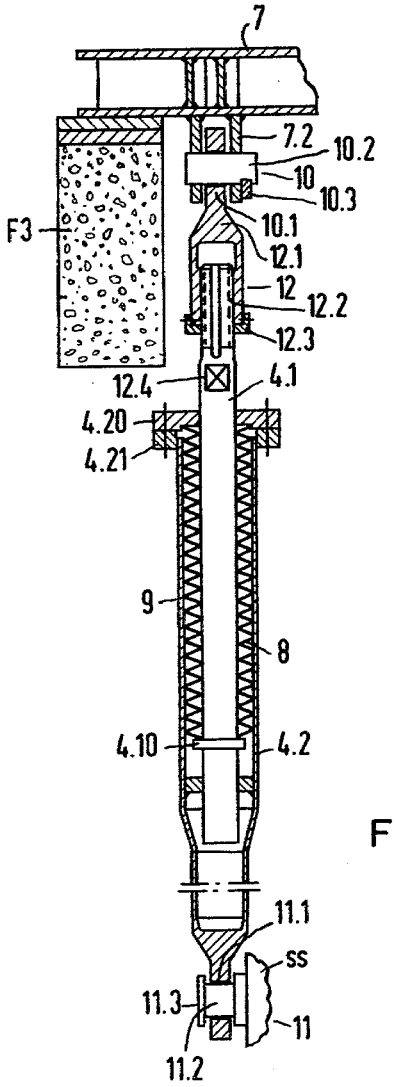

The constructions and method of operation of the invention, however, together with additional objects and advantages thereof will be best understood from the following description of specific embodiments whern read in connection with the accompanying drawings in which:

FIGS. 1, 2 and 3 are, respectively, elevational, plan and side views of a first embodiment of a valve arrangement according to the invention;

FIGS. 4, 5 and 6 are views corresponding, respectively, to those of FIGS. 1 to 3, showing a second embodiment of a valve arrangement according to the invention, wherein, in contrast to the first embodiment, fast-closing intercept governing valves of the medium-pressure turbine section are disposed not at the head of the high-pressure turbine section in line with the main steam fast-closing governing valves, but laterally either on the left-hand or the right-hand side of the turbosets;

FIGS. 7 and 8 are elevational and plan views, respectively, of the suspension of an individual emergency-stop governing valve (in principle, this may be an emergency-stop main-steam governing valve or an emergency-stop intercept governing valve); and FIG. 9 is an enlarged, fragmentary sectional view of FIG. 7 showing an individual tie rod serving for the spring-elastic suspension of the valves, together with a cup or plate spring stack.

Referring now to the drawing and first, particularly, to FIGS. 1 and 2, there is shown therein a high-pressure turbine section HD, a medium-pressure turbine section MD and low-pressure turbine sections ND of a turboset identified as a whole by the reference character T and being of the single-shaft type wherein the sections are mounted along a common axis on foundation supports F and are disposed, for the most part, above a machine floor F1 (note FIG. 3). One of the low-pressure turbine sections ND is shown in its entirety, and only one-half of another one thereof is shown in a fragmentary view, since they are not of importance for an understanding of the invention. In general, the single-shaft turboset T shown has three such double-flow low-pressure turbine sections ND and, indeed for the 1000-$MW_{el}$ rating class, is thus a sextupleflow turbine on the low-pressure side. On the foundation supports F, likewise shown fragmentarily, the bearing housings of the turboset T are mounted and, for rotatably supporting the turboset shaft which has an axis represented by the broken line a, carry corresponding bearings with journal and thrust bearings, not otherwise shown in detail, in an in-line or aligned and thermally mobile arrangement. Such a bearing housing at the high-pressure end is provided in the form of a front bearing housing 2.

An intermediate foundation stage F2 is fixed to the foundation supports F; a foundation ceiling F3 disposed approximately at the height of the machine floor F1 in front of the turboset T is likewise held on these supports F.

Valves associated with the high-pressure and the medium-pressure turbine sections HD and MD are constructed as combined emergency-stop governing valves and, in the case of the high-pressure turbine section HD, are represented as emergency-stop main-steam governing valves identified in their entirety by reference character FV and, in the case of the medium-pressure turbine sections MD, as emergency-stop intercept governing valves AV. The main-steam lines leading from non-illustrated boilers or steam generators to the emergency-stop main-steam governing valves FV are identified by the reference characters h1 and shown in broken lines; they are connected to a vertically extending part ss of the respective emergency-stop from which the steam flows to a horizontal valve part r thereof, which is structurally combined with the valve part ss and serves as the respective control or governing valve FV, and from the horizontal valve part r through main steam lines h2 into the high-pressure turbine section HD. From the outflow side of the high-pressure turbine section HD, lines h3 lead to a non-illustrated reheater and after the high-pressure turbine exhaust steam has been reheated in the reheater, it travels to the inflow region of the double-flow medium-pressure turbine sections MD through the emergency-stop intercept governing valves AV and lines m1. From the outflow side of the medium-pressure turbine MD, cross-over lines m21 and m22 lead to the inflow region of the low-pressure turbine sections ND connected thereto. The steam expanded in the ND-turbine travels through an exhaust steam nozzle or union ND1 to the turbine condensers K, which are not shown in detail, and is conducted back into the boiler through non-illustrated boiler feed pumps, preheaters and corresponding lines.

As shown in FIGS. 1 to 3, the emergency-stop main-steam governing valves FV are located in front of the head of the high-pressure turbine HD and under the machine floor F1 and are suspended thermally mobile from hereinafter more fully described beams of the upper foundation ceiling F3. In particular, four emergency-stop main-steam governing valves FV, which are individually identified by the reference characters FV1 to FV4, are provided for the high-pressure turbine HD which has four inflow nozzles; two of the main-steam governing valves FV1 and FV2, respectively, are disposed in front of the head and of the turboset T to the left-hand side of the machine axis, as viewed in FIG. 3, and two main-steam governing valves FV3 and FV4, respectively, in front of the head of the turboset T and to the righ-hand side of the machine axis, as viewed in FIG. 3, or as if one were viewing the turboset T from the left-hand side of FIG. 2. In this first embodiment of FIGS. 1 to 3, the emergency-stop intercept governing valves AV, like the emergency-stop main-steam valves FV are disposed forward of the head of the high-pressure turbine section HD or the turboset T, respectively, in fact, also below the machine floor F1 and at herinafter further described beams forming part of the upper foundation ceiling F3 that are not visible in FIGS. 1 to 3. As is apparent, the main-steam governing valves FV and the intercept governing valves AV are arranged in line or alignment in an axially normal plane and, since the medium-pressure turbine MD has four inflow nozzles, four intercept governing valves AV1 to AV4 are provided also in the embodiment shown in FIGS. 1 to 3. As is evident, the volume or size of the intercept governing valves AV1 to AV4 is larger than that of the main-steam governing valves FV and, also, the cross section of the steam lines m1 is greater than that of the lines h2, since the specific volume of the steam flowing through the intercept governing valves AV and the steam lines m1 is greater than the specific volume of the main or live steam. In the interest of clarity, the lines extending from the reheater to the intercept governing valves are not illustrated. As can further be seen, the main-steam governing valves MV and the intercept governing valves AV are disposed virtually mirror-symmetrically to the longitudinal machine axis a and, on both sides of a centrally suspended intercept-governing valve group AV1 t0 AV4, one mainsteam governing valve half-group FV1 to FV2 each is provided (to the left-hand side of the machine axis a, as viewed from the left-hand side of FIG. 2) and the other main-steam governing valve half-group FV3 and FV4 (to the right-hand side of the machine axis). The intermediate foundation stage F2, which is disposed below the valve arrangement FV and AV, functions as an assembly platform and for access to the valve space 3 surrounded by the casing or housing 2 to provide maintenance or servicing. As can be seen, good accessibility is provided to all the valves FV, AV, a feature which is important for installation and servicing. In particular, the steam lines h1, h2 and m1 and the non-illustated steam lines coming from the reheater can be welded conveniently to the connecting nozzles or unions of the valves.

In the second embodiment shown in FIGS. 4 to 6, parts like those in FIGS. 1 to 3 are provided with the same reference characters, with the exception of the emergency-stop main-steam governing valves which are identified by FV', FV1' and the like, and with the exception of the emergency-stop intercept governing valves, which are identified by AV', AV1' and the like. The last-mentioned reference characters serve to identify the intercept governing valves AV' located to the right-hand side of the machine axis a, as viewed in direction of the arrow a1, while an intercept governing valve group which is a variant or modified form of this embodiment of the valves AV' and located to the left-hand side of the machine axis a is identified by AV1", AV2" and the like. In this embodiment, as shown most clearly in FIG. 5, only the main-steam governing valves FV' are disposed forward of the head of the high-pressure turbine HD, while the intercept governing valves AV' are suspended, as mentioned hereinbefore, laterally of the machine axis a and, depending upon the spatial relationships or conditions, the right-hand arrangement AV' or the left-hand arrangement AV" can be selected.

In the embodiment of FIGS. 4 to 6, as well as in the first embodiment according to FIGS. 1 to 3, thermally mobile suspension of the main-steam and the intercept governing valves FV, AV, and FV', AV', respectively, is understood to mean that they can follow the thermal expansions of the steam lines connected thereto i.e. the lines h1 to h3 and m1 and the non-illustrated lines coming from the reheater and connected to the intercept governing valves AV, Av'. The advantages which were commented upon in connection with the first embodiment of FIGS. 1 to 3 and, even more explicitly, in the introduction to the specification apply analogously also to the second embodiment of FIGS. 4 to 6.

In FIGS. 7 to 9, further details of the valve suspension can be seen. It is evident therefrom that the housing axis a2 of the emergency-stop valve body ss and the housing axis a3 of the governing or control valve body r are perpendicular to one another, suspension elements in the form of tension or tie rods 4 engaging the emergency-stop valve body as in vertical disposition of the housing axis a2 thereof. A switching drive 5 is associated with the emergency-stop valve part ss. A positioning or control drive 6 is associated with the emergency-stop valve part r. The corresponding valve spindles are identified by reference characters 5.1 and 6.1, respectively. The combined valve construction shown in FIG. 7 is provided both for the main-steam governing valves FV, FV', as well as for the intercept governing valves AV, AV', however, with a greater overall volume or size for the intercept governing valves AV, AV', for which reason, in FIGS. 7 and 8, the valve shown therein is generally identified by the reference character V. The spring-elastic suspension of the valve V is accomplished by means of the hereinafore previously mentioned tie rods 4, which are linked at one end thereof to articulating locations or joints 7.1 of the beams 7 and at the other end thereof to articulating locations or joints ss1 of the valve parts or housings ss. As shown in FIG. 9, the tie rods 4 are formed of two rod parts each, namely, a pin part 4.1 and a sleeve part 4.2, the pin and sleeve parts 4.1 and 4.2, respectively, being coupled one to the other by a cup spring or Belleville washer stack or package 8 slipped over the pin part 4.1 and through a stop 4.10 of the pin part 4.1 and a stop 4.20 of the sleeve part 4.2 that are associated with the ends of the spring stacks or packages 8. The stop 4.20 is in the form of a ring flange, which is screwed to a ring-shaped end plate 4.21 of the sleeve part 4.2 after the cup spring stack or package 8 has been inserted into the annular space formed between the pin part 4.1 and the sleeve part 4.2. The stop 4.10 is in the form of a rod collar. The pin and the sleeve parts 4.1 and 4.2, respectively, are therefore shiftable relative to one another in axial direction and are displaceable spring-elastically, so that the valve can follow any possible thermal movements of the steam lines. In this regard, the cardanic or gimbal-like joints 10 and 11 which are provided between the tie rods 4, on the one hand, and the beams 7 or the valve housing ss, on the other hand, are especially advantageous. Moreover, articulating joint or hinge eyes 10.1 and 11.1 of the tie rods 4 extend with spherical bearing surfaces over joint pins 10.2 (note the upper part of FIG. 9) or the bearing pins 11.2, the bearing pins 10.2 being fixed to the beam plate or straps 7.2 and the bearing pins or posts 11.2 on the valve housing ss. A safety or locking plate 10.3 serves to secure the pin 10.2 against axial movement i.e. secures it against falling out, and a lock washer 11.3 secures the coupling between the joint eye 11.1 and the pin or post 11.2. At the upper end of the tie rod 4, a screw connection 12, secured against rugning, is provided for longitudinal adjustment of the tie rod 4, the length of the pin part 4.1 being variable. In particular, a threaded sleeve part 12.1, a threaded pin part 12.2 with a protection device 12.3 against rugning and a square hole 12.4 for receiving a wrench therein are provided for this purpose. Varying the length of the tie rods 4 serves to compensate for tolerances during installation of the valves V i.e. during connection thereof to the steam lines.

In the installed condition of the cup spring stack or packet 9, shown in FIG. 9 and in the installed condition of the associated valve V, the cup spring stack 9 is prestressed or under bias because the weight of the valve V and, in part, the weight of the steam pipes connected thereto rest on the spring column or stack 9. A thermal movement in direction of the valve axis a2 (in direction of the force of gravity) or against gravity is thus afforded and, in addition, an oscillating movement of the tie rods 4 about the axis of the joint pins 10.2 and about an axis perpendicular thereto is also afforded due to the spherical shape at 10.1 i.e. mobility in all directions.

As shown especially in FIGS. 7 and 8, the beams 7 are disposed in an approximately triangular shape, the two beams 7*a* and 7*b* forming a "V" and the corners of the triangle formed by the V lying with a three-point support at the locations A, B and C on shoulders F3.1 (note also FIG. 7) of the foundation ceiling F3. The legs 7*a* and 7*b* of the beams are bolted to these support shoulders F3.1 by means of mounting plates or straps 13. The tie rods 4 which extend vertically downwardly from the beam plates or straps 7.2 (note FIG. 7) engage three articulating joint locations ss1, preferably distributed uniformly over the circumference of the valve body ss, so that the valve V is supported by means of a three-point suspension with respect to the tie rods 4. This is a statically defined suspension which, however, simultaneously affords thermal movement.

The installation of the valves V is relatively very simple. The valves V can be set down by a building crane from above, secured in the position thereof, on a suitable support of correct height on the intermediate foundation stage F2; then, the beams 7 can be brought into position on the foundation ceiling F3 and, thereafter, the tie rods 4 can be connected to the valves V and the beams 7. To remove the valve support, the beams 7 with the valves V suspended therefrom can be lifted slightly. Then the steam pipes can be welded on.

As hereinaforementioned, the invention is not limited to the embodiments shown; it is also applicable to turbosets which have only high-pressure and low-pressure turbine sections or only medium-pressure and low-pressure sections. It is further applicable to turbosets having combined saturated-steam and low-pressure turbine sections. The emergency-stop main-steam governing valves FV and the emergency-stop intercept governing valves AV could also be interchanged in the first embodiment shown in FIGS. 1 to 3. In some circumstances, an alternating arrangement of the valves AV1, FV1, AV2, FV2 and so forth in the valve line-up could also be advantageous.

It is claimed:

1. In a turboset having a high-pressure turbine stage and at least another turbine stage mounted on foundation supports and largely disposed above a machine floor, the high-pressure turbine stage being connectible to main steam lines, a valve arrangement comprising emergency-stop main-steam governing valves through which the high-pressure turbine stage is connectible to the main steam lines, said emergency-stop main-steam governing valves being disposed forward of the head of the high-pressure turbine stage and below the machine floor, and including an upper foundation ceiling disposed approximately at the level of the machine floor and formed with beams from which said emergency-stop main-steam governing valves are thermally displaceably suspended.

2. In a turboset according to claim 1 wherein the other turbine stage is a medium-pressure turbine stage connectible to steam lines coming from a reheater, the valve arrangement also comprising emergency-stop intercept governing valves through which the medium-pressure turbine stage is connectible to the steam lines coming from the reheater, said emergency-stop intercept governing valves being also disposed below the machine floor and thermally displaceably suspended from said beams forming said upper foundation, said emergency-stop intercept governing valves being also located together with said emergency-stop main-steam governing valves forward of the head of the high-pressure turbine stage.

3. In a turboset according to claim 1 wherein the other turbine stage is a medium-pressure turbine stage connectible to steam lines coming from a reheater and axially aligned with the high-pressure turbine stage, the valve arrangement also comprising emergency-stop intercept governing valves through which the medium-pressure turbine stage is connectible to the steam lines coming from the reheater, said emergency-stop intercept governing valves being also disposed below the machine floor and thermally displaceably suspended from said beams forming said upper foundation, said emergency-stop intercept governing valves being located laterally of the axis of the turboset.

4. The valve arrangement according to claim 2 or 3 wherein the valves of at least one of said emergency-stop main-steam and said intercept governing valve types are respectively disposed in mutual alignment.

5. The valve arrangement according to claim 2 wherein the high-pressure and medium-pressure turbine stages are in axial alignment and wherein said main-steam and said intercept governing valves are disposed virtually mirror-symmetrically to the longitudinal axis of the turboset, all of the valves of one of said emergency-stop main-steam and intercept governing valve groups being centrally suspended and half of the valves of the other of said governing valve groups, respectively, being disposed on both sides of said valves of said one governing valve group.

6. In a turboset according to claim 1 wherein the other turbine stage is a medium-pressure turbine stage connectible to steam lines coming from a reheater, the valve arrangement also comprising emergency-stop intercept governing valves through which the medium-pressure turbine stage is connectible to the steam lines coming from the reheater, said main-steam and said intercept governing valves, respectively, being formed of a combination of an emergency-stop valve member and a governing valve member, respectively, disposed perpendicularly to one another, said emergency-stop valve member having a housing with a vertical longitudinal axis, and including suspension elements for the suspension of said governing valves, said suspension elements engaging with the respective emergency-stop valve member.

7. Valve arrangement according to claim 6 wherein said suspension elements are formed as tie rods spring-elastically suspending said governing valves, said tie rods being articulatingly connected at one end thereof to said beams of said upper foundation ceiling and articulatingly connected at the other end thereof to said housing of said emergency-stop valve member.

8. Valve arrangement according to claim 7 wherein said tie rods are formed, respectively, of a pin part and a sleeve part having respective stops associated therewith, and including a stack of cup springs slidably received on said pin part and having respective ends in engagement with said stops for mutually coupling said pin part and said sleeve part.

9. Valve arrangement according to claim 7 including a threaded connection secured against turning located at an end of said tie rods for adjusting the length thereof.

10. Valve arrangement according to claim 7 wherein the articulating connection between said tie rods, on the one hand, and said beams and said housings of said emergency-stop valve members, on the other hand, is formed by gimbal-like articulating locations.

11. Valve arrangement according to claim 10 wherein said gimbal-like articulating locations, respectively, comprise articulating joint eyes formed on said tie rods and having spherical bearing surfaces, support plates extending from said beams of said upper foundation ceiling, articulating joint pins, fixed to said support plates and to said housings of said emergency-stop valve members, respectively, said articulating-joint eyes, respectively, surrounding and engaging said articulating joint pins.

12. Valve arrangement according to claim 11 wherein said upper foundation ceiling is formed with shoulders and said beams of said upper foundation ceiling have an approximately triangular configuration and are disposed with a three-point support, respectively, in vicinity of the points of the triangle, on said shoulders formed on said upper foundation ceiling, said tie rods extending vertically downwardly from said support plates to three of said articulating locations formed on the periphery of the respective housing of said emergency-stop valve member.

13. Valve arrangement according to claim 12 wherein said three articulating locations are uniformly distributed over the periphery of the respective housing of said emergency-stop valve member.

* * * * *